United States Patent [19]

Nohira

[11] 4,112,894

[45] Sep. 12, 1978

[54] APPARATUS FOR RECIRCULATING EXHAUST GASES

[75] Inventor: Hidetaka Nohira, Susono, Japan

[73] Assignee: Toyota Jidosha Kogyo Kabushiki Kaisha, Japan

[21] Appl. No.: 654,176

[22] Filed: Feb. 2, 1976

[30] Foreign Application Priority Data

Oct. 3, 1975 [JP] Japan ..... 50-118927

[51] Int. Cl.[2] ..... F02M 7/12

[52] U.S. Cl. ..... 123/119 A

[58] Field of Search ..... 123/119 A

[56] References Cited

U.S. PATENT DOCUMENTS

| | | | |
|---|---|---|---|
| 3,796,049 | 3/1974 | Hayashi | 123/119 A |
| 3,881,456 | 5/1975 | Nohira | 123/119 A |
| 3,888,222 | 6/1975 | Tomita | 123/119 A |
| 3,962,868 | 6/1976 | Matumoto | 123/119 A |
| 3,977,381 | 8/1976 | Fujikawa | 123/119 A |
| 3,999,737 | 12/1976 | Hashiguchi | 123/119 A |
| 4,002,154 | 1/1977 | Kestner | 123/119 A |
| 4,033,309 | 7/1977 | Hayashi | 123/119 A |
| 4,044,739 | 8/1977 | Miura | 123/119 A |

FOREIGN PATENT DOCUMENTS

| | | | |
|---|---|---|---|
| 2,351,721 | 5/1974 | Fed. Rep. of Germany | 123/119 A |
| 2,400,029 | 7/1974 | Fed. Rep. of Germany | 123/119 A |
| 2,417,001 | 12/1974 | Fed. Rep. of Germany | 123/119 A |

*Primary Examiner*—Martin P. Schwadron
*Assistant Examiner*—Abraham Hershkovitz
*Attorney, Agent, or Firm*—Stevens, Davis, Miller & Mosher

[57] ABSTRACT

An apparatus for recirculating exhaust gases to an intake or suction system through an exhaust gas recirculating valve means to be operated in response to negative pressure in the suction system in an internal combustion engine, which comprises a second control valve means connected to a first control valve means of said recirculating valve device to respond to the negative pressure in an intake pipe to control the opening of the first control valve means in response to the load, whereby the proportion of an inert gas contained in an engine cylinder is made substantially constant in the partial load operation region.

3 Claims, 7 Drawing Figures

$R_2 = \frac{Ge+Gr}{Ga+Ge+Gr}$ $R_1 = \frac{Ge}{Ga}$

APPARATUS FOR RECIRCULATING EXHAUST GASES

Figure 1:
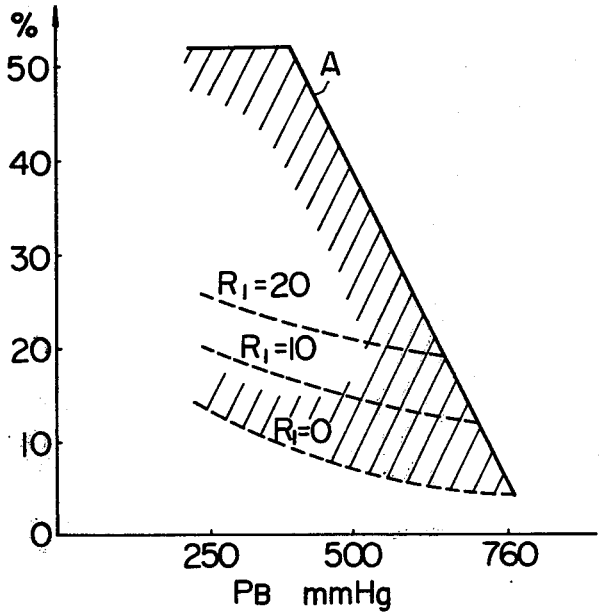

This invention relates to an apparatus for recirculating exhaust gases in an internal-combustion engine.

As means for reducing exhaust gases from an engine, especially $NO_x$ contained therein, there has been proposed a method in which a part of an exhaust gas is recirculated in the suction system to increase the amount of an inert gas and to lower the combustion temperature of a gas-fuel mixture. By the term "inert gas" used herein is meant a gas other than air to be mixed with a fuel. Namely, the inert gas includes gas left in a combustion chamber and a recirculated exhaust gas. This exhaust gas recirculating method has a considerable effect in reducing $NO_x$ in automobile engines. Accordingly, this method is practically worked broadly in this field. In this exhaust gas recirculating (hereinafter referred to as "EGR") system, various methods are adopted for controlling the amount of exhaust gas to be recirculated, but what is broadly adopted in the art is a so-called proportional EGR method in which the amount of recirculated exhaust gas is controlled in proportion to the amount of suction air.

In ordinary automobile gasoline engines, recirculated exhaust gas is not conducted (in this case, the proportion of the inert gas is equal to the proportion of the residual gas in the combustion chamber), the proportion of the inert gas in a cylinder is reduced as the pressure in the intake pipe is high, namely the load is high. In an engine having such characteristic, even when the exhaust gas is recirculated in proportion to the amount of suction air, only the proportion of the inert gas as a whole increases, and it has been found that the characteristic curve is not substantially changed (see FIG. 1). Accordingly, the proportion of the inert gas decreases as the load is high. Therefore, if the engine is operated under such characteristic conditions, the $NO_x$ concentration in the exhaust gas increases as the load is high, because the proportion of the inert gas decreases as the load is high, and hence, the effect of reducing $NO_x$ is lowered. More specifically, the amount of $NO_x$ formed in the combustion chamber is substantially influenced by the proportion of the inert gas present in the combustion chamber, and the above characteristic inherent to the proportional EGR is not preferred for the reduction of the formation of $NO_x$ when the load is high, because the proportion of the inert gas decreases at a high load. In contrast, when the load is low, the proportion of the inert gas increases and the effect of reducing $NO_x$ is enhanced. However, too large a proportion of the inert gas results in the wasteful use of fuel and in an increase of the fuel expenses. Accordingly, it is not permissible to increase the proportion of the inert gas without limitation. Therefore, what proportion of the inert gas should be adopted in response to the load has heretofore been determined in view of the regulated standard value of the exhaust gas and after due consideration of the fuel expenses, the power and other factors influencing the engine performance. In the conventional proportional EGR system, since the proportion of the inert gas changes depending on the load, as pointed out hereinabove, it is impossible to set the proportion of the inert gas regardless of the load. This is an important problem involved in the conventional proportional EGR system.

It is therefore a primary object of this invention to provide an exhaust gas recirculating system in which recirculation of the exhaust gas is performed under such conditions that the proportion of the inert gas is not influenced by the load and the inert gas is present in a substantially constant proportion to suction air. Under the above conditions, chemical properties of a gas-fuel mixture can always be kept substantially constant and unchanged. Since combustion conditions are principally identical, substantially the same $NO_x$ concentration can always be obtained. Therefore, it will be possible to maintain the $NO_x$ concentration below the regulated standard value regardless of operation conditions.

A control system most preferred for performing EGR while making constant the proportion of the amount of an inert gas to the amount of suction air (strictly, the sum of the amount of suction air and the amount of the inert gas) will now be discussed logically.

In order to simplify the discussion, it is convenient to suppose that suction and exhaust are performed instantaneously at the bottom dead center and the top dead center respectively.

If the amount of suction air, the amount of the recirculated gas and the amount of the residual gas are expressed by Ga, Ge and Gr, respectively, and if the ratio of the exhaust gas to be recirculated and the ratio of the inert gas in the cylinder are expressed by $R_1$ and $R_2$, respectively, then equations (1) and (2) should hold as:

$$R_1 = \frac{Ge}{Ga} \tag{1}$$

$$R_2 = \frac{Ge + Gr}{Ga + Ge + Gr} \tag{2}$$

(A) When EGR is not performed, equation (2) is expressed as follows.

$$R_2 = \frac{Gr}{Ga + Gr} \approx \frac{Gr}{Ga} = \frac{1}{\epsilon} \cdot \frac{Pr}{P_\beta} \quad \frac{T_\beta}{Tr} \tag{3}$$
$$(R_1 = O)$$

wherein $\epsilon$ stands for the compression ratio, $Pr$ stands for the back pressure, $P_B$ stands for the intake pipe pressure, $T_B$ stands for the temperature of suction air, and $Tr$ stands for the temperature of the exhaust gas.

(B) When EGR is performed, as known in the prior art Ga and Gr are expressed as follows.

$$Ga = (aP_B - b)\Sigma Vh \cdot n_E \tag{4}$$

$$Gr = b\,\Sigma Vh \cdot n_E \tag{5}$$

wherein:

$$a = A\frac{\epsilon}{\epsilon - 1} \cdot \frac{1}{T_\beta} \approx \text{constant},$$

$$b = A\frac{1}{\epsilon - 1} \cdot \frac{Pr}{T_r} \approx \text{constant},$$

*A:* constant, $Vh$: amount of exhaust, and $n_E$: rotation number of engine.

If equation (1) is rewritten as $Ge = R_1Ga$, $R_2$ is expressed as follows.

$$R_2 = \frac{R_1Ga + Gr}{(1 + R_1)Ga + Gr} = \frac{R_1 \cdot aP_\beta + (1 - R_1)b}{(1 + R_1)aP_\beta - R_1b} \tag{6}$$

A characteristic curve obtained by substituting concrete values into equations (1) and (6) is shown in FIG. 1. Three cases of $R_1=0$ (EGR is not performed), $R_1=10(\%)$ and $R_1=20(\%)$ are shown in FIG. 1. From this characteristic curve, it will readily be understood that, as pointed out hereinbefore, the proportion $R_2$ of the inert gas decreases as the intake pipe pressure $P_B$ is high and that even if the ratio $R_1$ of the exhaust gas to be recirculated is enhanced, the characteristic curve as a whole merely shifts substantially in parallel.

The following equation is obtained by rearranging equation (6).

$$R_1 = \frac{R_2}{1-R_2} - \frac{b}{a}\ \frac{1}{(P_\beta - b/a)} \tag{7}$$

If the difference between the intake pipe pressure $P_B$ and the atmospheric pressure (760 mm Hg) is expressed by $P$, the following relation is established.

$$P_B = 760 - P$$

If the value of $P$ is sufficiently small, equation (7) can be rewritten as follows.

$$R_1 \approx \frac{R_2}{1-R_2} - \frac{b}{760a}\left(1 + \frac{P}{760}\right) \tag{8}$$

If the value of $R_2$ is made constant according to this invention, namely if $R_2$ is expressed by a certain constant, $R_1$ can be expressed as follows.

$$R_1 = C_1 - C_2P \tag{9}$$

wherein:

$$C_1 = \frac{R_2}{1-R_2} - \frac{b}{760a} = \text{constant, and}$$

$$C_2 = \frac{b}{760a} = \text{constant.}$$

From the foregoing, it will readily be understood that in order to perform EGR while keeping the proportion ($R_2$) of the inert gas constant, control should be made so that $R_1$ (=Ge/Ga) precisely satisfies equation (7) and approximately satisfies equation (9).

Figure 2:
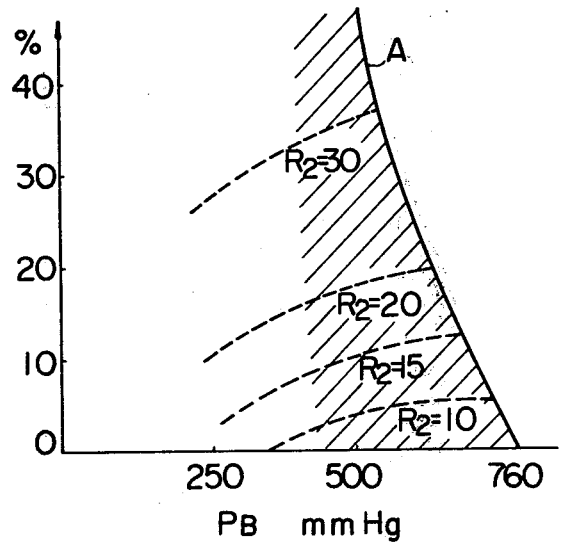

FIG. 2 shows a curve showing the relation between $R_1$ and $P_B$, which was obtained by substituting appropriate values into equation (8) in the cases of $R_2=10$, 15, 20 and 30. From this curve, it will readily be understood that in order to keep constant the proportion $R_2$ of the inert gas in the cylinder, the proportion $R_1$ of the amount of the recirculated exhaust gas to the amount of suction air should be made small as the suction pipe pressure $P_B$ is small. In each of FIGS. 1 and 2, line A is a boundary line determined by the maximum air amount and the condition should be chosen within a hatched region below this boundary line A.

Control means suitable for changing the proportion of the amount of recirculated exhaust gas to the amount of suction air in response to the negative pressure of the intake pipe will now be considered.

As the EGR system now adopted in the art, there can be mentioned the Above the Throttle Blade Entry EGR System, in which the exhaust gas is recirculated above a throttle valve, and the Below the Throttle Blade Entry EGR or Manifold Entry EGR System, in which the exhaust gas is recirculated below a throttle valve or to an intake manifold. Both the systems will now be considered.

(I) Above the Throttle Blade Entry EGR System

In this case, the amount Ge of the recirculated gas is basically expressed by the following equation.

$$Ge = K_1 \cdot A \cdot \sqrt{Pr - Po} \tag{10}$$

wherein $K_1$ stands for a constant, $A$ denotes a minimum throttle area (generally defined by the valve and valve seat of the EGR valve means), $Pr$ stands for the back pressure and $Po$ denotes a throttle bore pressure (approximating the atmospheric pressure).

Approximately, the relation of $Pr \propto Ga^2$ holds and, therefore, equation (10) can be expressed as follows.

$$Ge = K_1' \cdot A \cdot Ga \tag{11}$$

wherein $K_1'$ stands for a constant.

As is seen from equation (11), the amount $Ge$ of the recirculated gas is in proportion to the amount $Ga$ of suction air, and this system corresponds to the proportional EGR system mentioned in the opening part above.

(II) Below the Throttle Blade Entry EGR System

The EGR valve means used in this system have a constant pressure chamber as described below and the EGR amount is controlled so that the pressure in this constant pressure chamber is approximately equal to the atmospheric pressure. The amount $Ge$ of the recirculated gas is basically expressed by the following equation.

$$Ge = K_2 \cdot A \cdot \sqrt{Pr - Po} \tag{12}$$

wherein $K_2$ is a constant, $A$ stands for an inlet area of the constant pressure chamber, $Pr$ stands for a back pressure and Po denotes a pressure in the constant pressure chamber (approximating the atmospheric pressure).

As in the case of the system (I), $Ge$ is approximately expressed as follows.

$$Ge = K_2' \cdot AGa \tag{13}$$

Thus, it will readily be understood that this system is also a proportional EGR system in which $Ge$ is in proportion to $Ga$.

Since the relation of $Ge=R_1Ga$ holds as shown in equation (1), the following relation can be derived from equations (11) and (13).

$$R_1 = L \cdot A \tag{14}$$

wherein $L$ is $K_1'$ or $K_2'$ (constant).

Since the relation of equation (14) is established in either EGR system (I) or EGR system (II), in order to keep constant the proportion $R_2$ of the inert gas according to the concept of this invention, it is sufficient that the following requirement derived approximately from equation (9) should be satisfied.

$$A = C_1' - C_2'P \tag{15}$$

wherein $C_1'$ and $C_2'$ each stand for a constant and $P$ is equal to $(760-P_B)$.

Namely, the area of the flow control zone of the EGR valve means should be controlled as a coefficient of the intake pipe pressure as shown by equation (15).

Based on the theory developed hereinbefore, the area of the flow control zone of the EGR valve means is automatically adjusted in response to the intake pipe pressure in this invention.

Further properties of the invention will become apparent from the detailed description which follows hereinafter.

Figure 3:
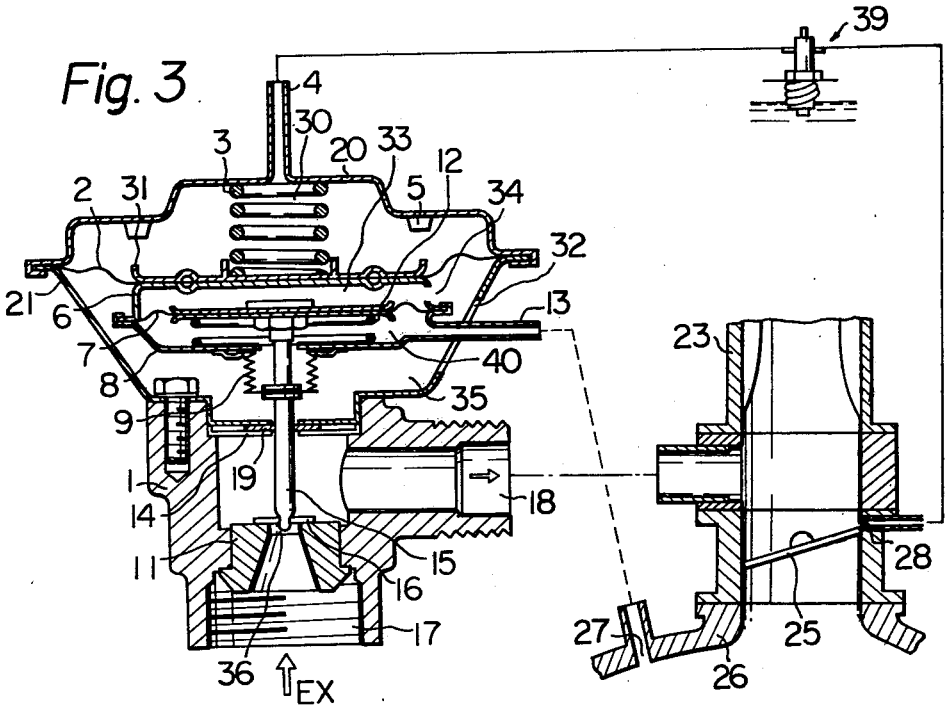
Figure 4A:
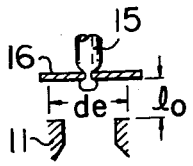
Figure 4B:
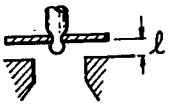
Figure 5:
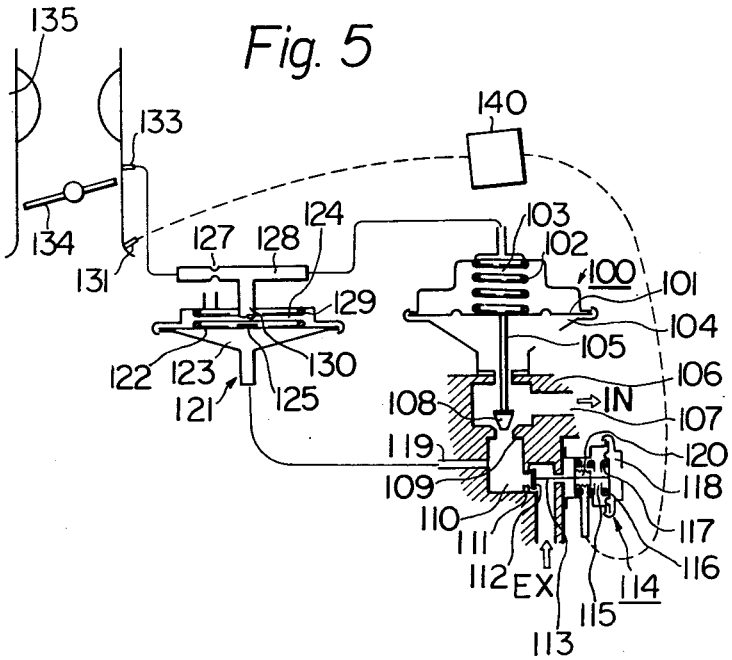
Figure 6:
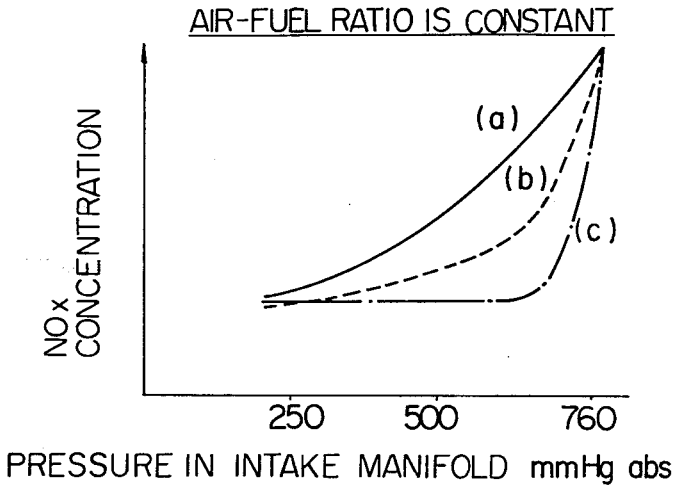

Two embodiments of the invention are illustrated in the accompanying drawings which are given by way of nonlimitative examples and in which;

FIG. 1 is a diagram illustrating the characteristic of the proportion of the inert gas in the cylinder in the conventional proportional EGR system, FIG. 2 is a curve showing the relation between the proportion $R_1$ of the amount of recirculated exhaust to the amount of suction air and the intake pipe pressure, which satisfies the requirement for keeping the proportion of the inert gas constant according to this present invention, FIG. 3 is a diagram illustrating one embodiment of the apparatus of this invention, FIGS. 4*a* and 4*b* are views showing the main part of the apparatus of FIG. 3 at different positions, FIG. 5 is a diagram showing another embodiment of the apparatus of the present invention, and FIG. 6 is a characteristic curve of the $NO_x$ concentration where the present invention and the conventional technique are compared with each other.

FIG. 3 illustrates an embodiment where this invention is applied to the Above Throttle Blade Entry EGR System.

An EGR valve means is provided with 2 overlapped diaphragm operation mechanisms according to this invention. A valve box 1 has an EGR gas inlet 17 for recirculating exhaust gas coming from an exhaust system EX (not shown) and an EGR gas outlet 18 for recirculating the exhaust gas to above a throttle valve 25 of a carburetor 23. A frame of a diaphragm operation chamber proper formed by a diaphragm casing 21 and a casing lid 20 is fixed on the valve box 1. The interior of this operation chamber proper is isolated from an exhaust gas passage in the valve box 1 by a seal plate 14 and a heat insulating plate 19, so that it is not influenced by the high temperature exhaust gas. A first diaphragm 2 is air-tightly spread between the casing lid 20 and the diaphragm casing 21. The first diaphragm 2 is always urged downwardly by a first spring 3 through a retainer 31 fixed to the first diaphragm 2. A stopper 5 for the retainer 31 is disposed to control the quantity of upward deviation of the first diaphragm 2. A pressure plate 6 is fixed to the lower face of the first diaphragm 2, and the pressure plate 6 is engaged with a second diaphragm case 8. A second diaphragm 7 is spread between the plate 6 and the case 8. Both overlapped first diaphragm chamber 30 (negative pressure operation chamber) and second diaphragm chamber 40 (negative pressure operation chamber) are sealed chambers and they are connected through sensing connecting pipes 4 and 13 to ports 28 and 27 opened into the intake pipe or manifold, respectively. A second open chamber 33 above the second diaphragm 7 is connected to a first open chamber 35 formed in the diaphragm casing 21 through an opening 34 formed on the pressure plate 6. These chambers are always opened to the open air through an opening 32 formed on the diaphragm casing 21.

The second diaphragm 7 is always urged upwardly in the figure by a second spring 12 stronger than the first spring 3. A valve stem 15 is fixed to the second diaphragm 7 so that it moves in the vertical direction together with the second diaphragm. A bellows 9 is disposed to allow the valve stem 15 to move while keeping air-tightness in the second diaphragm operation chamber 40. The valve stem 15 penetrates through the seal plate 14 and the heat insulating plate 19 and it has an EGR valve 16 at the lower end thereof. A valve opening 36 is formed by an orifice former 11 which acts as a valve seat of the EGR valve 16. A part 28 on the intake pipe side is opened slightly upstream of the idling opening of a throttle valve 25 and a port 27 is opened at a suitable part downstream of a throttle valve 25, for example, in an intake manifold 26.

When the negative pressure of the port 28 reaches, for example, 60 mm Hg, the negative pressure lifts up the first diaphragm 2 to the uppermost position against the first spring 3, where the retainer 31 is engaged with the stopper 5, and hence, the valve stem 15 is lifted up to the uppermost position and the EGR valve 16 is moved to the full opening position. Accordingly, under ordinary automobile driving conditions (of course, the negative pressure of the port is higher than the above prescribed value) the EGR valve reaches the full opening position where the valve stem 15 is at the uppermost position.

The negative pressure of the intake pipe 26 influences on the second diaphragm 7 through the port 27, and hence, the second diaphragm 7 is downwardly stretched against the second spring 12. As a result, the valve stem 15 which has been kept at the uppermost position by the upward pulling force of the first diaphragm 2 is returned downwardly by the second diaphragm 7, so that the valve stem occupies an intermediate position between the uppermost position (the valve full opening position) and the lowermost position (the valve full closing position). If the throttle valve 25 is above the port 28, the negative pressure is substantially equal between the ports 28 and 27, but since as pointed out hereinbefore, the first diaphragm 2 contracts the weak first spring 3 and is deviated to the uppermost position where the retainer 31 is engaged with the stopper 5, with increase of the negative pressure the valve stem 15 is downwardly deviated by the action of the second diaphragm 7 to narrow the flow passage area of the valve opening, and hence, the amount of the exhaust gas passing through this opening is decreased. In short, the operation state at this point satisfies the relation shown in FIG. 2. Reference numeral 39 denotes a controller for controlling the time of performing recirculation of the exhaust gas, and this may be a known device, such as a member sensing a temperature parameter, e.g., an engine exhaust gas temperature or a suction air temperature, a member sensing a speed parameter, e.g., a vehicle speed or an engine rotation number, or a member sensing a pressure parameter, e.g., an intake pipe negative pressure. For example, a mechanical three-way valve or an electromagnetic valve can be adopted as the controller 39. Two or more of these control members may be used in combination. In any event, by provision of such control member, it is made possible to recirculate the exhaust gas only at the time of ordinary regular operation.

When recirculation of the exhaust gas is unnecessary and the passage connecting in the port 28 and the first diaphragm chamber 30 is cut by the controller 39, the intake pipe negative pressure acts only on the second diaphragm chamber 35 through the port 27, and hence, the valve stem 15 is maintained at the lowermost position. Accordingly, the EGR valve is kept in the fully closed state and the exhaust gas is not recirculated.

Referring now to FIGS. 4*a* and 4*b*, it will be confirmed that the apparatus shown in FIG. 3 satisfies the relation of equation (15).

Supposing that the hydromechanically equivalent area of fluid passing through the valve opening when the valve stem 15 is at the uppermost position is expressed by Ao, then the following relation holds.

$$Ao = \pi d_e l_o \quad (16)$$

wherein $d_e$ stands for the equivalent diameter and $l_o$ stands for the maximum lift value.

If the valve stem 15 is downwardly deviated from the above state by the action of the second diaphragm, since the equivalent area A at this point is expressed as:

$$A = \pi d_e l \quad (17)$$

wherein $l$ stands for the lift value of the valve stem 15, which is expressed by equation $l = l_o(1 - KP)$ in which $K$ stands for a spring constant of the spring 12 and $P$ denotes the intake pipe negative pressure, the following relation is established.

$$A = \pi d_e l_o (1 - K_p) \quad (18)$$

Accordingly, it is seen that the relation of equation (15) is satisfied. Namely, the apparatus shown in FIG. 3 can recirculate the exhaust gas while keeping the proportion $R_2$ of the inert gas approximately constant.

FIG. 5 illustrates an embodiment where this invention is applied to the Below the Throttle Blade Entry EGR System.

The EGR valve means comprises a first control valve means 100 and a second control valve means 114. This first control valve means per se is known in the art. A diaphragm chamber 103 of the first control valve means 100 is connected through a regulator 121 to a port 133 opened upstream of a throttle valve 134 of a carburetor 135 when it is under idling opening. The other chamber 104 of the first control valve means 100 is an atmospheric pressure chamber opened to the open air. A valve stem 105 is fixed to a diaphragm 101 which moves in the vertical direction in the figure to open and close a valve 108. With opening of the valve 108, exhaust gas is recirculated from an exhaust gas system EX (not shown) through an EGR gas inlet, a throttle 111, a constant pressure chamber 110 and the valve 108 to below the throttle valve of the carburetor or to the intake manifold, as indicated by an arrow in the figure.

The regulator 121 is known per se, and it has two chambers 124 and 123 partitioned by a diaphragm 122. The chamber 124 forms an atmospheric pressure chamber opened to the open air and the other diaphragm chamber 123 is connected to the lower chamber 110 of the first valve means 100. The diaphragm 122 is always urged downwardly by a spring 129. A stop seat 125 is disposed at the center of the diaphragm 122. This seat 125 performs the function of closing an air bleed nozzle 130 exposed to the chamber 124 when the diaphragm 122 is upwardly deviated. A throttle 127 is mounted at the center of a sensing pipe passage 128 connecting the diaphragm chamber 103 of the first control valve means 100 to the port 133. Further, a controller 140 similar to the controller 39 shown in FIG. 3 is interposed in a conduit connecting the diaphragm chamber 103 and the sensing pipe passage 128.

The second control valve means 114 according to this invention is mounted on a throttle 111 forming the inlet of the lower chamber 110 of the first control valve means 100. This second control valve means 114 corresponds to the second diaphragm device of the embodiment shown in FIG. 3. The second control valve means 114 has two chambers partitioned by a diaphragm 116, one being an atmospheric chamber 118 opened to the open air and the other being a diaphragm chamber 115 connected to a port 131 opened downstream of a throttle valve 134 of the carburetor. The diaphragm 116 is always pressed toward the side of the atmospheric pressure chamber 118 by means of a spring 117. Reference numeral 120 denotes a bellows similar to the bellows 9 shown in FIG. 3.

The operation of the apparatus shown in FIG. 5 is basically identical with the operation of the apparatus shown in FIG. 3. More specifically, when a negative pressure is imposed on the port 133 on the intake pipe side, if the air bleed nozzle 130 is closed by the stop seat 125 mounted on the diaphragm 122, namely if a back pressure is imposed on the diaphragm chamber 123 by the exhaust gas in the lower chamber 110 (of course, at this point the valve 108 of the EGR valve device is closed), this port negative pressure acts on the diaphragm chamber 103 of the first control valve means 100 of the EGR valve device, and it lifts up the diaphragm 101 and in turn the valve stem 105 to open the valve 108. As a result, the exhaust gas passes through the valve 108 and is recirculated to the intake manifold IN as indicated by an arrow in the figure. Thus, the pressure of the lower chamber 110 is lowered, and hence, the diaphragm 122 is pushed up to the normal position by the spring 129 to open the air bleed nozzle 130. As a result, the negative pressure of the port 133 is air-bled and the negative pressure is not transmitted to the diaphragm chamber 103. Accordingly, the diaphragm 101 is pushed down by the spring 102 and the valve 101 is closed. Thus, the pressure in the lower chamber 110 is increased again, and the above-mentioned cycle of operations is repeated. In short, the regulator 121 acts as an automatic adjustment valve as if it were a thermostat in the temperature sensor system.

The operation of the second control valve means 114 according to this invention is quite the same as that of the diaphragm device having the second diaphragm 7, which is illustrated in FIG. 3. Accordingly, explanation of the operation of the second control valve means 114 is omitted. As regards the equivalent area flow rate controlling valve 112, the requirement of equation (18) is substantially satisified, and the intended recirculation of the exhaust gas can be performed while keeping constant the proportion of the inert gas in the cylinder.

FIG. 6 is a diagram showing the results of experiments conducted by using the apparatus shown in FIG. 3. Curve (*a*) shows results obtained when EGR was not performed, curve (*b*) shows results obtained when proportional EGR was performed according to the conventional technique and curve (*c*) shows results obtained when EGR was conducted according to the present invention. From the results shown in FIG. 6, it will readily be understood that the concentration of exhausted $NO_x$ is made substantially constant regardless of the intake pipe pressure in the present invention.

As will be understood from the foregoing description, according to the present invention, since recirculation of the exhaust gas is performed while keeping substantially constant the proportion of the inert gas in the cylinder, the present invention can overcome troubles and disadvantages involved in the conventional proportional EGR system, which are caused by an increase in the proportion of the inert gas in the cylinder in the low load operation region and by a decrease in said proportion in the high load operation region, such as unstable combustion and reduction of the $NO_x$ removing effect in the high load operation region. In other words, according to the present invention, a certain correcting function by the intake pipe negative pressure is newly added and by this function, the proportion of the inert gas in the cylinder can be kept substantially constant, whereby the $NO_x$ concentration can be effectively reduced. Furthermore, since the proportion of the inert gas in the cylinder can be kept constant, chemical conditions for combustion are kept constant, and hence, simplification of control of, for example, ignition time, can be attained conveniently. Thus, it is made possible to manufacture an engine capable of always reducing the $NO_x$ concentration below a prescribed level with the foregoing various advantages.

What I claim is:

1. A recirculating exhaust gas control system for maintaining a substantially constant proportion of inert gas to total gas in the cylinders of an operating engine comprising:

an exhaust system connected with said engine;

a fuel and air supply system for said engine containing a throttle valve therein;

conduit means connecting said exhaust system to said supply system to supply recirculated inert gas to said cylinders;

exhaust gas recirculating valve means disposed in said conduit for regulating the flow of said recirculated inert gas therethrough, said valve means including a first pressure responsive valve device biased toward a conduit blocking position and responsive to the negative pressure existing in said supply system upstream of said throttle for unblocking said first conduit by an amount proportional to said upstream negative pressure, a second pressure responsive valve device biased toward a conduit opening position and responsive to the negative pressure existing in said supply system downstream of said throttle for blocking said first conduit by an amount proportional to said downstream negative pressure, and a constant pressure chamber disposed in said recirculated inert gas path between said first and second valve devices; and, regulator means responsive to the pressure existing in said constant pressure chamber for controlling the operation of said first pressure responsive valve device to maintain a substantially constant pressure in said chamber, said first and second valve devices and regulator means operating to control the flow of said recirculated inert gas through said conduit to maintain a substantially constant proportion of inert gas to total gas contained in said cylinders at any partial load operating region of said engine.

2. A recirculating exhaust gas control system as set forth in claim 1, wherein said first valve device comprises a first negative pressure operated diaphragm chamber which is coupled to the upstream negative pressure area of the intake system and a first valve member which is fixed to a first diaphragm forming a partition of the first negative pressure operated diaphragm chamber and which can be displaced integrally with said diaphragm to allow and stop the flow of the exhaust gas to be recirculated through said first valve device; said second valve device comprises a second negative pressure operated diaphragm chamber partitioned by a second diaphragm and connected to the downstream negative pressure area of the intake system and a second valve member fixed to said second diaphragm and displaced integrally therewith to control the amount of exhaust gas to be recirculated through said second valve device, independently of said first valve member; said regulator means air-bleeds the upstream negative pressure signal applied to said first pressure responsive valve device and, said constant pressure chamber is connected to a diaphragm operation chamber of said regulator means.

3. A recirculating exhaust gas control system as set forth in claim 2, wherein said apparatus further comprises a controller arranged in a line connecting the first negative pressure-operated diaphragm chamber to the upstream negative pressure area of the intake system, said controller being provided with a member sensing a temperature parameter, speed parameter or a pressure parameter in a vehicle to control the amount of time the recirculation of the exhaust gas is performed.

* * * * *